United States Patent [19]

Parker et al.

[11] 3,973,503

[45] Aug. 10, 1976

[54] TOW CART SAFETY MECHANISM

[75] Inventors: Bruce W. Parker; Jim H. Morrison; Arliss B. Noble, all of Norman, Okla.

[73] Assignee: Westinghouse Electric Corporation, Pittsburgh, Pa.

[22] Filed: Feb. 21, 1975

[21] Appl. No.: 551,940

[52] U.S. Cl. ..... 104/172 BT

[51] Int. Cl.[2] ..... B61B 13/12

[58] Field of Search ..... 104/172 R, 172 B, 172 BT, 104/170, 178; 180/91, 92, 93; 74/106, 110, 520

[56] References Cited

UNITED STATES PATENTS

| | | | |
|---|---|---|---|
| 1,498,099 | 6/1924 | Howland-Shearman | 74/106 |
| 3,106,172 | 10/1963 | Robbins et al. | 104/172 BT |
| 3,659,530 | 5/1972 | Klamp | 104/172 BT |
| 3,789,767 | 2/1974 | Krammer | 104/172 BT |
| 3,824,930 | 7/1974 | Biessener | 104/172 BT |
| 3,844,183 | 10/1974 | Wilke | 74/520 X |

*Primary Examiner*—Robert J. Spar
*Assistant Examiner*—Randolph A. Reese
*Attorney, Agent, or Firm*—E. C. Arenz

[57] ABSTRACT

A tow cart is provided with an arrangement in which the tow or drive pin is adapted to be moved out of engagement with the conveyor drive, in response to a predetermined degree of obstruction to the tow cart, by a spring-loaded overcenter double toggle movable from a cocked to a released position in response to the obstruction, and in which the drive pin is pivotally supported so that it may swing forwardly away from the conveyor drive upon the release. In the cocked position of the toggle mechanism the mechanism restrains the forward pivotal movement of the drive pin.

10 Claims, 5 Drawing Figures

TOW CART SAFETY MECHANISM

BACKGROUND OF THE INVENTION

1. Field of the Invention

The invention pertains to the art of drive and safety release arrangements for tow carts.

2. Description of the Prior Art

As is well known in this art, an in-floor, tow-line cart system includes a number of tow trucks or carts which are driven by a below floor conveyor system which engages the bottom end portion of a tow pin or drive pin which extends down from the cart through a slot in the floor. These systems include main lines and spur lines to which the carts may be switched. It is common in such systems to provide bumper arrangements and cooperating mechanism which permit a number of successive carts to be accumulated and stop if the first cart has encountered an obstacle. Such arrangements typically provide for lifting the tow or drive pin out of engagement with the conveyor, but not out of the slot in the floor. Some arrangements also include a means for braking the carts. Examples of U.S. patents disclosing such arrangements generally are: U.S. Pat. Nos. 3,659,530; 3,581,670, 3,547,043 and 3,467,023.

Most of the tow-line systems that we are aware of are used, to the best of our knowledge, in warehousing type of operations in which the storage and handling of material is the principal function of the operation. In other words, those people in the vicinity of the tow-line system are mainly concerned with the operation of the system itself to accomplish the handling of the material carried by the system. However, tow-line systems may also be used in manufacturing installations where the tow line brings material to a machine operator whose principal concern is with operating a machine, rather than the handling of the material being performed by the tow-line system. In other words, where a tow line is provided in a warehousing operation the personnel are watching the operation of the tow line, whereas in a manufacturing operation the personnel are not watching the operation of the tow line. Therefore the problems of personnel safety arising from the use of a tow-line system in a manufacturing operation, as contrasted to a warehousing operation, is significantly greater.

It is our view that the release mechanisms of the types illustrated in the noted patents, as well as others available in commercially available tow-line systems, may be adequate in a warehousing operation but are inadequate from the standpoint of personnel safety in a manufacturing operation. We believe this to be so because the degree of obstruction required with these prior art arrangements to effect the release of the drive pin from the conveyor means is sufficiently great that if the obstruction were a person the person could be severely injured before the release was effected.

Thus an aim of our invention is to provide a drive pin release arrangement capable of being actuated with a lesser degree of obstruction than those arrangements of which we are aware, to the end of reducing the chance and severity of personnel injury from the cart.

SUMMARY OF THE INVENTION

In accordance with the invention, the arrangement includes a drive pin carried by the cart and having one end adapted to be engaged by the conveyor drive, with the drive pin being supported for axial movement to place one end portion into and out of engagement with the conveyor drive. Stored force means and an over-center toggle mechanism having a cocked and a released position restrain forward movement of the engaging end portion of the drive pin relative to the cart in the cocked position, and release the forward restraint and substantially simultaneously exert a force to move the engaging end portion axially out of engagement with the drive means upon release of the stored force means, which is triggered in response to a predetermined degree of obstruction to the forward movement of the cart.

In the preferred arrangement, the pin means is supported for forward pivotal movement of the engaging end portion about a pivotal connection between the cart and a portion of the pin means remote from the engaging end.

DRAWING DESCRIPTION

DESCRIPTION OF THE PREFERRED EMBODIMENT

While the invention will be described in detail in connection with a tow cart travelling on a floor, the principles of the invention are considered to be applicable as well to a suspended cart system.

Figure 1:
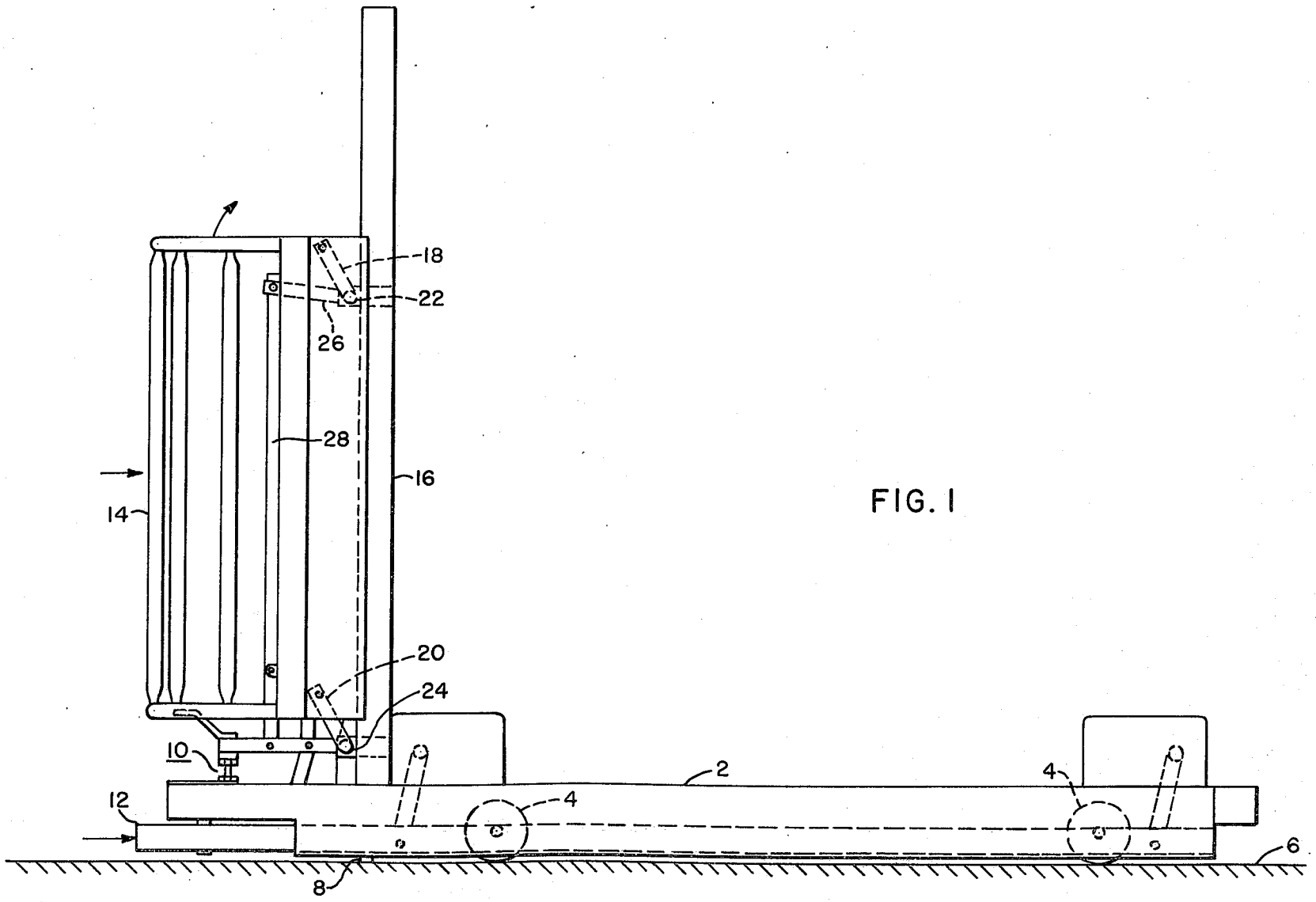
FIG. 1 is a simplified side view of a tow cart of the type incorporating the invention, omitting details of the mechanism according to the invention and showing the personnel cage and bumper in a normal operating position.
Figure 2:
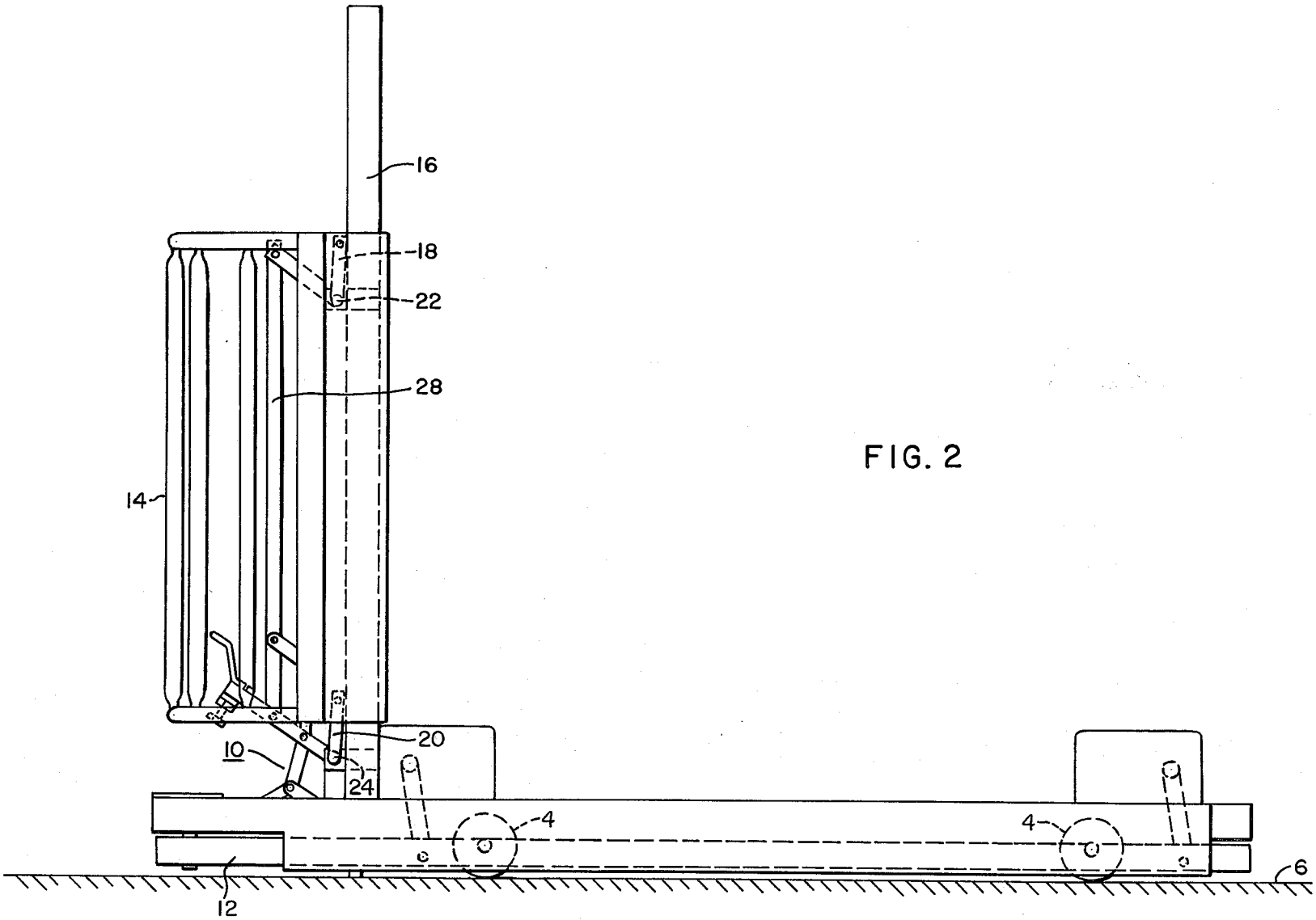
FIG. 2 is a side view of a tow cart as in FIG. 1 but with the personnel cage and bumper retracted in response to an obstruction.

The basic structure of the tow cart system shown in FIGS. 1 and 2 is conventional and includes a cart bed 2 carried on wheels 4 from floor 6 which has a slot therein which receives the lower end portion of a drive pin 8 adapted to be engaged by the conveyor drive means underlying the floor. For clarity in FIGS. 1 and 2, the mechanism for effecting the movement of the drive pin 8 out of the slot is not shown but occupies the space generally designated 10 near the front of the tow cart.

The release of the drive pin 8 from the conveyor drive may be effected by an obstruction of sufficient degree being engaged by either the bumper 12 located closely above the floor or, the personnel cage 14 mounted forwardly of the front upright frame 16. The obstruction will cause the bumper 12 and personnel cage 14 to be moved to the positions shown in FIG. 2, and actuate the withdrawal of the drive pin from the conveyor drive. Shifting the bumper 12 to the rear also results in the rear end portion of the bumper being displaced rearwardly to a position flush with the rear end of the cart so that the front bumper of the next successive cart will engage the rear end portion and, if sufficient obstruction exists, be displaced rearwardly also.

The personnel cage 14 is supported from the tow cart on upper and lower cage pivot arms 18 and 20 so that a sufficient obstruction of the cage will cause the cage to be displaced upwardly and rearwardly from the FIG. 1 to the FIG. 2 position. An upper cage pivot rod 22 extending across substantially the width of the tow cart has its ends journaled in structure connected to the upright frame and the rear ends of the cage pivot arms 18 are fixed to the cage pivot rod 22. A pair of axially aligned lower pivot rods 24 also extend across most of the width of the tow cart and the rear ends of the lower cage pivot arms 20 are fixed to the lower pivot rods. Additionally, a central upper link 26 has its rear end fixed to the middle of the upper cage pivot rod 22 and has its front end pivotally connected to the cage lifter rod 28 which links the movement of the personnel cage with the underlying mechanism occupying the space 10. The means by which the concurrent movement of the personnel cage and the bumper occurs will become more readily apparent in connection with the description of the mechanism of FIGS. 3–5.

Figure 3:
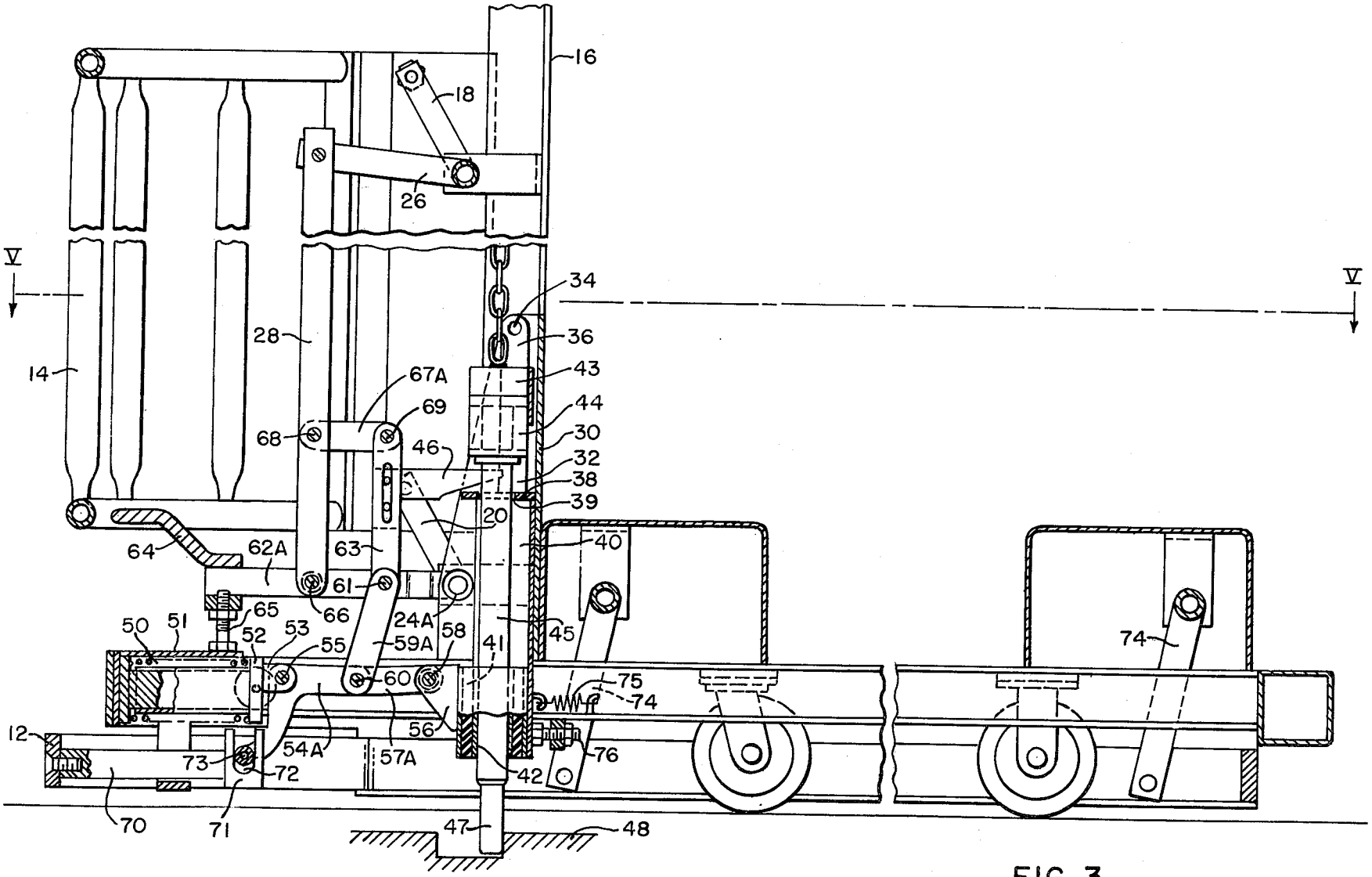
FIG. 3 is a fragmentary vertical sectional view corresponding to one taken along the line III—III of FIG. 5 and emphasizing the structural details of the arrangement with the mechanism in a cocked position for normal cart operation.
Figure 4:
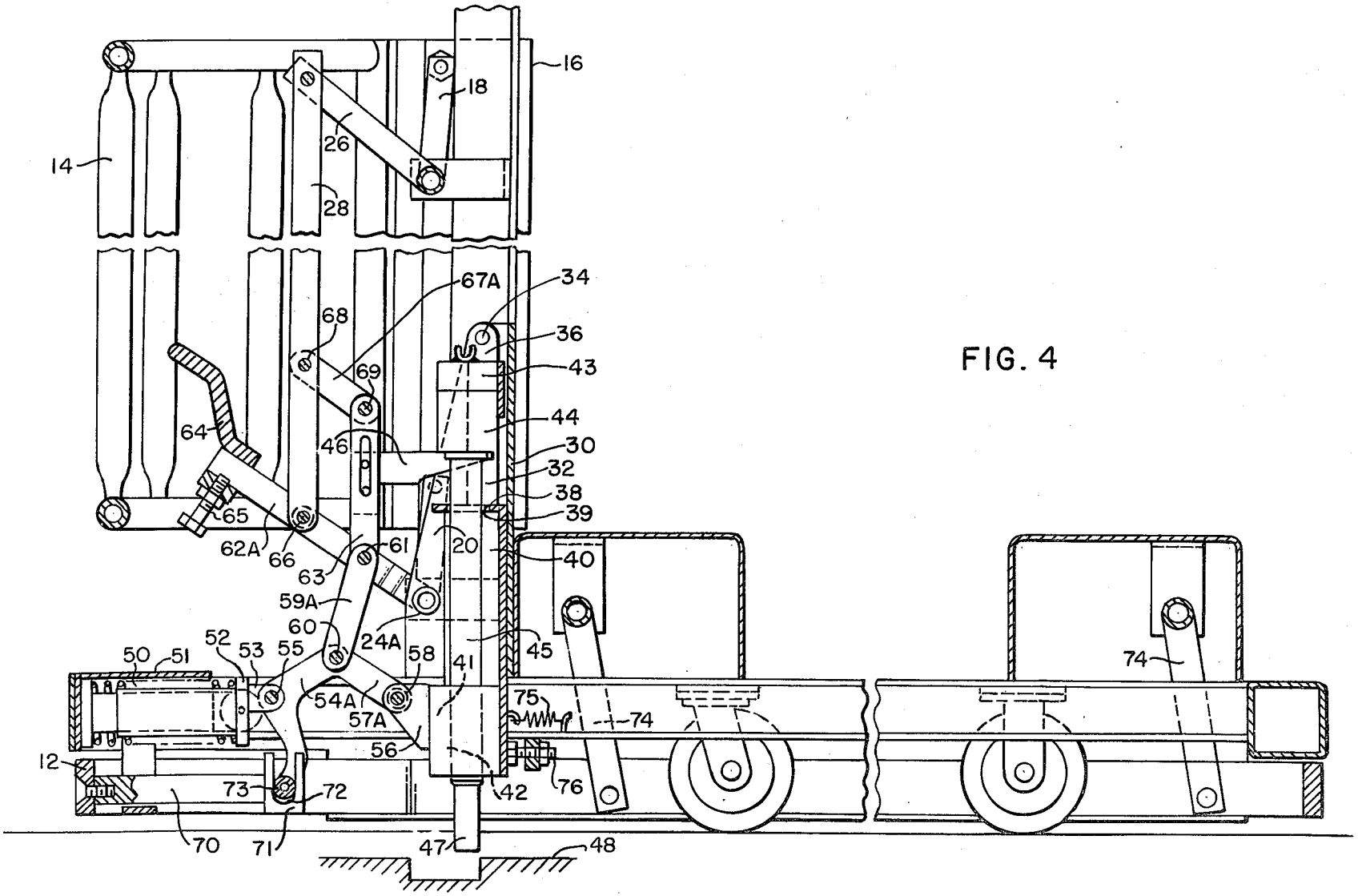
FIG. 4 is a fragmentary vertical sectional view as in FIG. 3, but with the mechanism shown in a released position.
Figure 5:
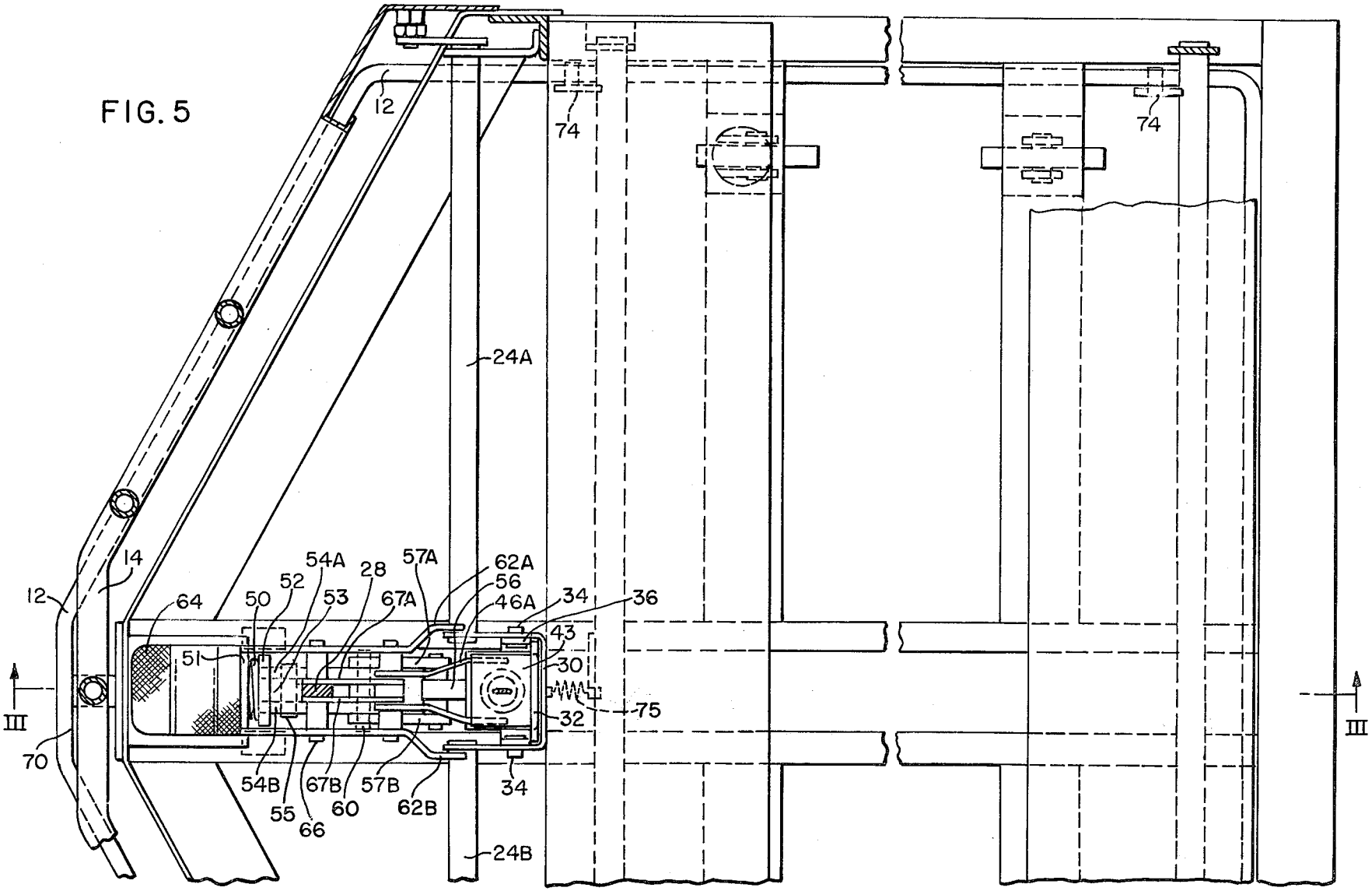
FIG. 5 is a partly-broken, fragmentary horizontal sectional view corresponding to one taken along line V—V of FIG. 3.

Referring to FIGS. 3–5, a pin pivot housing 30, which is generally channel-shaped in horizontal cross section and is forwardly open, is disposed vertically immediately in front and centered relative to the front upright frame 16. A pin retainer pivot assembly 32 is nested within the pivot housing and is pivotally supported by opposite pivot pins 34 at the top. The pin retainer pivot assembly comprises opposite side arms 36 which are pivotally supported by the pins 34 and which in turn support a horizontally disposed upper pin guide plate 38 having a central opening 39 therein. The guide plate has attached thereto a depending, forwardly-open channel 40 which has a sleeve-shaped shock bushing and lower guide 41 fixed within the lower end of the channel 40. The bore 42 in the shock bushing 41 is aligned with the aperture 39 in the upper guide plate 38, and the clearances are adequate that the drive pin means received in these aligned openings may be freely moved axially.

The drive pin means includes an upper steel block 43 having an upwardly-open, U-shaped member 44 welded thereto. The bottom of the U has a central opening through which the drive pin shank 45 extends. The upper end of the pin shank is secured to the block 43. The bottom of the U-shaped member 44 provides shoulders on either side of the pin adapted to be engaged by lift fingers 46 for purposes of moving the drive pin as a whole upwardly so that the lower engaging-end portion 47 may be moved out of engagement with the conveyor drive means 48. The way in which the lift fingers 46 are moved will be described in connection with the mechanism which moves them.

From the foregoing description, it will be appreciated that the fixed pin pivot housing 30 provides a forwardly-open, vertically-disposed channel within which the pin retainer pivot assembly 32 is nested and supported therefrom by the pivotal connections 34 at the top so that the pin retainer pivot assembly is susceptible of being pivoted forwardly at the bottom. The drive pin 45 carried by the pin retainer pivot assembly is also capable of being moved axially up or down to be placed out of or into engagement with the conveyor drive means 48.

In accordance with the invention, an obstruction of a predetermined degree to the forward movement of the tow cart, sensed by either the front bumper 12 or the personnel cage 14, is to effect a lifting of the drive pin 45 to a position in which its lower end portion 47 is out of engagement with the drive means 48. The mechanism by which this is accomplished in cooperation with the previously described arrangement of the drive pin means and its cooperating supporting arrangement will now be described.

A stored force means and an overcenter double-toggle mechanism are basic to the arrangement according to the invention. The stored force means in the preferred embodiment comprises a compression spring 50 (FIGS. 3–5) in a housing 51 fixed to the cart. The spring exerts a force in a rearward direction against a push plate 52. The rear face of the push plate 52 carries a lug 53 pivotally connected to central portions of a pair of crank arms 54A and 54B on opposite sides of the lug by pivot pin 55. It is here noted that where double or paired links, arms, etc., perform the same function, those on the left as viewed from the front of the cart will be designated by A following the numeral, while those on the right will be designated by B following the numeral. The shock bushing 41 carries a lug 56 on its forward face and another pair of arms 57A and 57B forming a part of the toggle are pivotally connected on either side of lug 56 by the pivot pin 58. The pairs of toggle arms 54 and 57 are pivotally connected to each other and to a pair of connecting links 59A and 59B of the pivot pin 60. The upper ends of the connecting links 59 are pivotally connected by pin 61 to a pair of reset levers 62A and 62B and to a single lifter rod 63 to which the pair of lift fingers 46 are attached.

The rear ends of the pair of reset levers 62 (FIGS. 3–5) are welded to the lower pivot rods 24A and 24B, the inner ends of which are journaled for rotation in the vertical side wings of the pin pivot housing 30. The forward ends of the pair of reset levers 62 carry a foot pedal 64 on the top surface and a vertically adjustable bolt 65 in inverted position so that the head of the bolt may seat on the top surface of the spring housing 51. The foot pedal is stepped on to move the mechanism back to a cocked position from a released position, and the adjustable bolt 65 is set to properly locate the overcenter position of the pivot pin 60 of the double toggle mechanism to obtain the proper sensitivity for tripping the mechanism with a predetermined obstruction.

The bottom end of the cage connector rod 28 (FIGS. 3–5) is pivotally connected by pin 66 to and between the reset levers 62. The upper end of the lifter rod 63 is pivotally connected by a pair of connecting links 67A and 67B to an intermediate height location on the cage connecting rod 28 by pivot pins 68 and 69. As will be apparent from FIGS. 3 and 4, the levers, links and rods 28, 62, 63 and 67 form a parallelogram linkage.

The bumper 12 (FIGS. 3–5) is connected to actuate the toggle mechanism by a connecting rod 70 extending rearwardly from the prow of the bumper and carrying a crosshead element 71 at its rear having an upwardly open slot 72 into which the lower forward ends 73 of the crank arms 54 are rotatably received. The side portions of the bumper 12 (FIG. 5) extend from front to rear along the sides of the tow cart just inside the side skirts of the tow cart and are supported to permit the rearward displacement of the bumper by front and rear torsion bars 74 pivotally mounted at their tops to the tow cart bed.

A return spring 75 has its forward end connected to the pin retainer pivot assembly 32 and its rear end fixed to the cart structure. An adjustable bolt 76 is provided near the bottom end of the pin retainer pivot assembly to adjust for verticality of the pin.

The manner in which the arrangement described operates in accordance with the invention will now be explained in connection with FIGS. 3 and 4. The double toggle mechanism comprising the arms 54 and 57 is adjusted by means of the bolt 65 to locate the center pivot pin 60 with its axis slightly below the plane in which the axes of the pivot pins 55 and 58 lie with the mechanism cocked. This adjustment determines the degree of obstruction of the bumper or personnel cage relative to the forward motion of the tow cart which will trigger the toggle mechanism to obtain pin release. A balance is made between avoiding nuisance triggering, and alternatively obtaining sufficiently quick release with that degree of force corresponding to a person obstructing the tow cart.

Assume now that a person's foot is struck by the prow of the bumper 12 and provides sufficient resistance to forward motion of the cart that the connecting rod is moved rearwardly enough to rotate the crank arms 54 sufficiently that the pin 60 of the double toggle mechanism moves above dead center. At this point, the rearward force of the compression spring 50 tends to collapse the double toggle and thereby lift the connecting links 59. At the same time, the forward force of the conveyor drive means 48 upon the pin lower end 47 will also be tending to collapse the double toggle mechanism. This of course is resisted to some degree by the return spring 75 connected to the pin retainer pivot assembly. Upon the double toggle mechanism moving from its cocked position past dead center toward the released position of FIG. 4, the lifting of the connecting link 59 rotates the reset levers 62 in a clockwise direction about the axis of the lower pivot rods 24. This in turn raises the lifter rod 63 carrying the lift fingers 46 upwardly so that the rear end of the lift fingers engage the shoulders at the bottom of the U-shaped member 44 and thus carries the pivot pin 45 upwardly out of engagement between its lower end with the conveyor drive means 48 but not so far that the bottom end of the pin leaves the floor slot. Upon the movement of the double toggle mechanism from the cocked to the released position, the forward restraint exerted upon the drive pin means by the double toggle mechanism in its cocked position is now released and the pin retainer pivot assembly 32 is capable of pivoting forwardly about its upper pivot point 34.

It is considered to be an important feature of the invention that the pin is not only moved upwardly, but is capable of swinging forwardly about the pivot point 34 in case a heavy load on the tow cart, coupled with the movement of the conveyor drive means, results in a frictional force between the engaging end of the drive pin and the conveyor means such that the upward force derived from the compression spring has difficulty in elevating the pin. It will be appreciated that the force relationships involved in this are reasonably complex and basically depend upon the loading of the cart and the friction to forward movement of the cart, the force of the compression spring and the particular position of the toggle mechanism during its release operation at any given point in time, coupled with the instantaneous degree of push by the conveyor drive at that point in time, and the frictional resistances throughout the system. However these relationships are well within the capabilities of those skilled in the art and can be determined empirically for the most part.

In connection with the preferred arrangement permitting forward pivoting of the pin retainer pivot assembly 32 (FIGS. 3 and 4), the lift fingers 46 are attached to the lifter rod 63 to permit downward yielding or slip of the fingers relative to the rod in an extreme pin binding condition to allow the pivot action of the pin retainer pivot assembly. The fingers are shown in their slipped position in FIG. 4. The downward slip of the fingers relative to the lifter rod under such conditions more readily permits the pivoting of the pin retainer pivot assembly.

It is believed that it will be apparent that the obstruction afforded to the forward movement of the tow cart causing actuation of the mechanism may be accomplished by an obstruction either to the bumper 12 or the personnel cage 14 since their movement is linked by the cage lifter rod 28. Specifically, if the obstruction is afforded by the personnel cage, which then swings from its FIG. 1 to its FIG. 2 position, during this movement of the cage the cage lifter rod 28 lifts the reset levers 62 sufficiently to carry the toggle mechanism past its dead center position which permits the compression spring 50 to function as previously described in connection with an obstruction to the bumper 12.

It is considered to be a feature of significance of this invention that the double toggle mechanism serves not only in obtaining the lift of the drive pin means, but also in its cocked position affords a positive restraint to forward movement of the lower end of the pin retainer pivot assembly 32 and its carried drive pin 45.

We claim:

1. In a tow cart driven by conveyor drive means, a driving and release arrangement comprising:

drive pin means carried by said cart and having one end portion adapted to be engaged by said conveyor drive means;

means supporting said drive pin means for axial movement placing said one end portion into and out of engagement with said conveyor drive means;

a stored force means and an overcenter toggle mechanism associated therewith, said overcenter toggle mechanism having a cocked position and an alternate released position, said stored force means and said toggle mechanism restraining forward movement of said one end portion relative to said cart in said cocked position, and releasing said forward restraint to permit said one end portion to move freely away from said drive means and substantially simultaneously exerting a force to move said one end portion axially out of engagement with said drive means upon release of said stored force means; and means for moving said stored force means and toggle mechanism from said cocked position to said released position in response to a predetermined degree of obstruction to the forward movement of said cart.

2. In an arrangement according to claim 1 wherein:

said pin supporting means includes means supporting said pin means for forward pivotal movement of said one end portion of said pin means about a pivotal connection remote from said one end portion.

3. In an arrangement according to claim 2 including:

return spring means urging said one portion of said pin means rearwardly about said pivotal connection.

4. In an arrangement according to claim 1 wherein:

said stored force means comprises a compression spring located forwardly of a portion of said pin means adjacent said one end portion; and said toggle mechanism is located between said compression spring and said portion of said pin means adjacent said one end portion.

5. In an arrangement according to claim 4 wherein:

said overcenter toggle mechanism comprises a double toggle linkage having said cocked position on one side of dead center, and said release position on the other side of dead center.

6. In an arrangement according to claim 1 wherein:

said tow cart includes a floor line bumper displaceable rearwardly and connected to operate said means for moving said stored force means and toggle mechanism from said cocked to said released position.

7. In an arrangement according to claim 6 wherein:

said tow cart includes a personnel cage displaceable rearwardly; and linkage means connecting said personnel cage to said means for moving said stored force means and toggle mechanism from said cocked to said released position so that said predetermined degree of obstruction of either said bumper or said personnel cage will operate said last-named means.

8. In a floor supported tow cart driven by in-floor conveyor drive means, a driving and release arrangement comprising:

drive pin means carried by said cart and having a bottom end portion adapted to be engaged by said conveyor drive means;

means supporting said drive pin means for both axial movement placing said bottom end portion into and out of engagement with said conveyor drive means and for pivotal forward movement of said bottom end away from said conveyor drive means;

pin position control means, comprising a compression spring and an overcenter toggle mechanism associated therewith, holding said pin means in its rearward position in a cocked position of said pin position control means, and releasing said pin means for said forward pivotal movement to permit said bottom end portion to move freely away from said drive means and substantially simultaneously exerting a force to move said pin means upwardly upon triggering of said pin position control means from a cocked position toward a released position;

floor bumper means, and separate personnel cage means, carried by said cart and displaceable rearwardly relative to said cart in response to a predetermined degree of obstruction to forward movement of said bumper means and said cage means; and means linking both said bumper means and said cage means to said pin position control means to effect triggering thereof in response to said predetermined degree of obstruction of either.

9. In a floor supported tow cart driven by in-floor conveyor drive means, a driving and release arrangement comprising:

drive pin means carried by said cart and having a bottom end portion adapted to be engaged by said conveyor drive means;

means supporting said drive pin means for both axial movement placing said bottom end portion into and out of engagement with said conveyor drive means and for pivotal forward movement of said bottom end away from said conveyor drive means;

pin position control means holding said pin means in its rearward position in a cocked position of said pin position control means, and releasing said pin means for said forward pivotal movement to permit said bottom end portion to move freely away from said drive means and substantially simultaneously exerting a force to move said pin means upwardly upon triggering of said pin position control means from a cocked position toward a released position;

floor bumper means, and separate personnel cage means, carried by said cart and displaceable rearwardly relative to said cart in response to a predetermined degree of obstruction to forward movement of said bumper means and said cage means; and means linking both said bumper means and said cage means to said pin position control means to effect triggering thereof in response to said predetermined degree of obstruction of either, said linking means includes a parallelogram linkage, one element thereof comprising a portion of a reset lever, and an adjacent element comprising a lifter rod carrying lift finger means adapted to engage said pin means for effecting lifting thereof.

10. In an arrangement according to claim 9 wherein:

said lift finger means is yieldably connected to said lifter rod.

* * * * *